US008036412B2

(12) United States Patent
Kaderavek et al.

(10) Patent No.: US 8,036,412 B2
(45) Date of Patent: Oct. 11, 2011

(54) MICROPHONE SYSTEM HAVING PRESSURE-GRADIENT CAPSULES

(75) Inventors: Johann Kaderavek, Vienna (AT); Klaus Alois Haindl, Vienna (AT)

(73) Assignee: AKG Acoustics GmbH

( * ) Notice: Subject to any disclaimer, the term of this patent is extended or adjusted under 35 U.S.C. 154(b) by 1106 days.

(21) Appl. No.: 11/241,781

(22) Filed: Sep. 30, 2005

(65) Prior Publication Data

US 2006/0083390 A1 Apr. 20, 2006

(30) Foreign Application Priority Data

Oct. 1, 2004 (EP) ..... 04450184

(51) Int. Cl.
*H04R 9/08* (2006.01)

(52) U.S. Cl. ..... 381/357; 381/355; 381/356; 381/369

(58) Field of Classification Search ..... 381/181, 381/355–360, 369, 365
See application file for complete search history.

(56) References Cited

U.S. PATENT DOCUMENTS 5,703,957 A * 12/1997 McAteer ..... 381/92
6,597,793 B1 * 7/2003 Darbut et al. ..... 381/313
6,614,911 B1 * 9/2003 Watson et al. ..... 381/86
6,788,791 B2 * 9/2004 Smith et al. ..... 381/92
6,885,751 B2 * 4/2005 Pribyl ..... 381/174
7,106,876 B2 * 9/2006 Santiago ..... 381/369
7,146,013 B1 * 12/2006 Saito et al. ..... 381/92
2003/0165251 A1 9/2003 Pribyl

FOREIGN PATENT DOCUMENTS

EP 1 351 549 A2 10/2003

* cited by examiner

*Primary Examiner* — Curtis Kuntz
*Assistant Examiner* — Ryan Robinson

(57) ABSTRACT

A microphone system may include a housing having a housing opening. Pressure-gradient capsules may be provided in the housing. The capsules may include a diaphragm and at least one sound entry opening. One sound entry opening may be connected with a front side of the diaphragm in an acoustically conductive manner and another sound entry opening may be connected with a rear side of the diaphragm in an acoustically conductive manner. The sound entry openings may be located in each of the pressure-gradient capsule on an entry surface. The diaphragms of the pressure-gradient capsules may be oriented substantially parallel to each other. The sound entry opening may be directed into a space, which may be closed in a direction perpendicular to the entry surface. The space may be connected to the housing opening in an acoustically conductive manner. The microphone system may be compact and robust, and it may be suitable for use with hands-free devices.

32 Claims, 7 Drawing Sheets

MICROPHONE SYSTEM HAVING PRESSURE-GRADIENT CAPSULES

BACKGROUND OF THE INVENTION

1. Priority Claim

This application claims the benefit of priority of European Application No. 044 50 184.9, filed Oct. 1, 2004, which is incorporated by reference.

2. Technical Field

The invention relates to a microphone system, and in particular, to a microphone system for use with hands-free devices.

3. Related Art

A microphone system may produce high quality sound; however, the directional characteristics or patterns of the microphone system may need to be adjusted and changed during operation. The directional characteristics may indicate a relative sensitivity of the microphone system to approaching sound. The microphone system may pick up sound from all directions or from some directions. Alternatively, the microphone system may pick up sound coming from a front or from a lateral location. Because the microphone system may be used in a moving space such as automobiles, airplanes, etc. and with moving objects such as singers, actors, etc, the microphone system should be compact and/or inconspicuous. For instance, the microphone system may be mounted on shirts of singers and actors. In addition, the microphone system also should be robust and resistant to vibrations and mechanical impacts.

SUMMARY

A compact and robust microphone system for use with hands-free devices is provided. The microphone system may include a housing and pressure-gradient capsules. The housing may have an opening. The pressure-gradient capsules may have diaphragms. In each pressure-gradient capsule, a first sound entry opening may be connected to a front side of the diaphragm in an acoustically conductive manner. A second sound entry opening may be connected with a rear side of the diaphragm in an acoustically conductive manner. At least one of the first sound input opening or the second sound input opening may be subdivided. The first and second sound entry openings may be directed into a space configured to be closed in a direction perpendicular to an entry surface and connected with the housing opening in an acoustically conductive manner.

The microphone system may perform signal processing techniques. The pressure-gradient capsules may be aligned with respect to each other such that directional characteristics or patterns of audio signals may be produced. Audio signals generated at the pressure-gradient capsules may be provided to an analog-to-digital converter to be converted in a digital, format. The converted audio signals may be sent to a control unit that analyzes the audio signals. The audio signals may be filtered by an adaptive filter. The control unit may drive the adaptive filter based on analysis of the audio signals. For instance, the control unit may determine properties of the adaptive filter.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
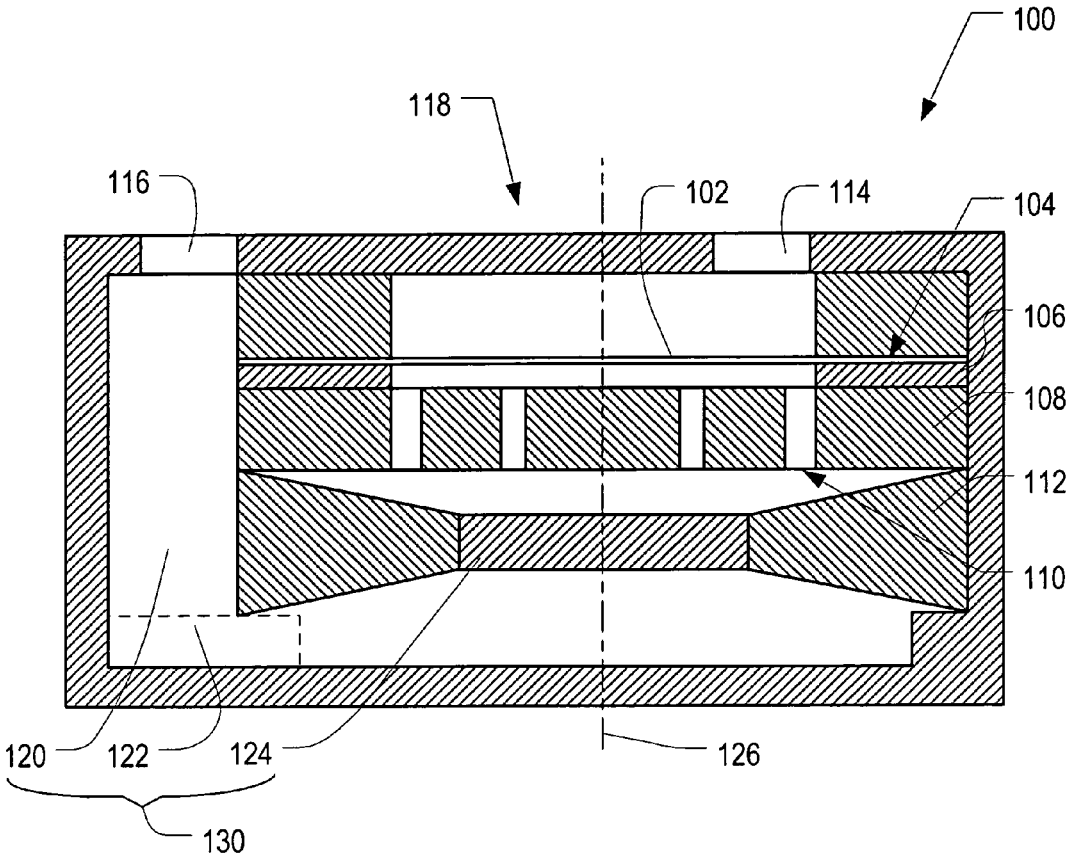
Fig. 1 (Prior Art)
FIG. 1 is an example of a pressure-gradient capsule having sound entry openings.

FIG. 1 illustrates a conventional electrostatic pressure-gradient capsule 100 of a microphone system. The capsule 100 may include a diaphragm 102 mounted onto a diaphragm ring 104. The diaphragm 102 may be mounted with a spacer ring 106 so that it is distanced from an electrode 108. The electrode 108 may include bores. One side 110 of the electrode 108 may face away from the diaphragm 102. An acoustic friction structure 112 may be provided to acoustically adjust the microphone capsule 100. A front side 118 may have two openings 114 and 116. One opening 114 may permit sound waves to enter the front side of the diaphragm 118. A second opening 116 may permit sound waves to enter the rear side of the diaphragm 102 through a sound duct 130. The sound duct 130 may include three sections 120, 122 and 124 that extend past components of the capsule 100. A directional characteristic or pattern of sound may be asymmetric to a diaphragm axis 126.

Both openings 114 and 116 may be provided on the same side of the capsule 100. The capsule 100 may be mounted substantially flush with or behind flat mounting surfaces (not shown), so that space may be saved and so that the system may be visually appealing.

Figure 2:
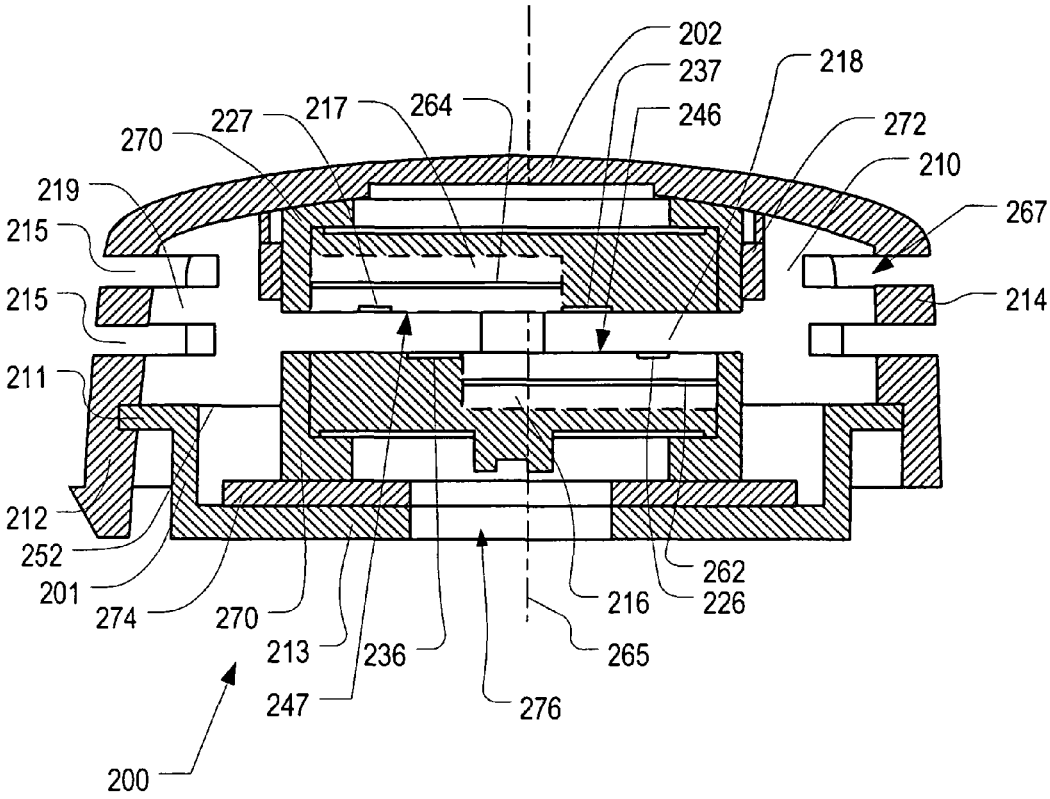
FIG. 2 is a first exemplary microphone system with two pressure-gradient capsules facing each other.
Figure 3:
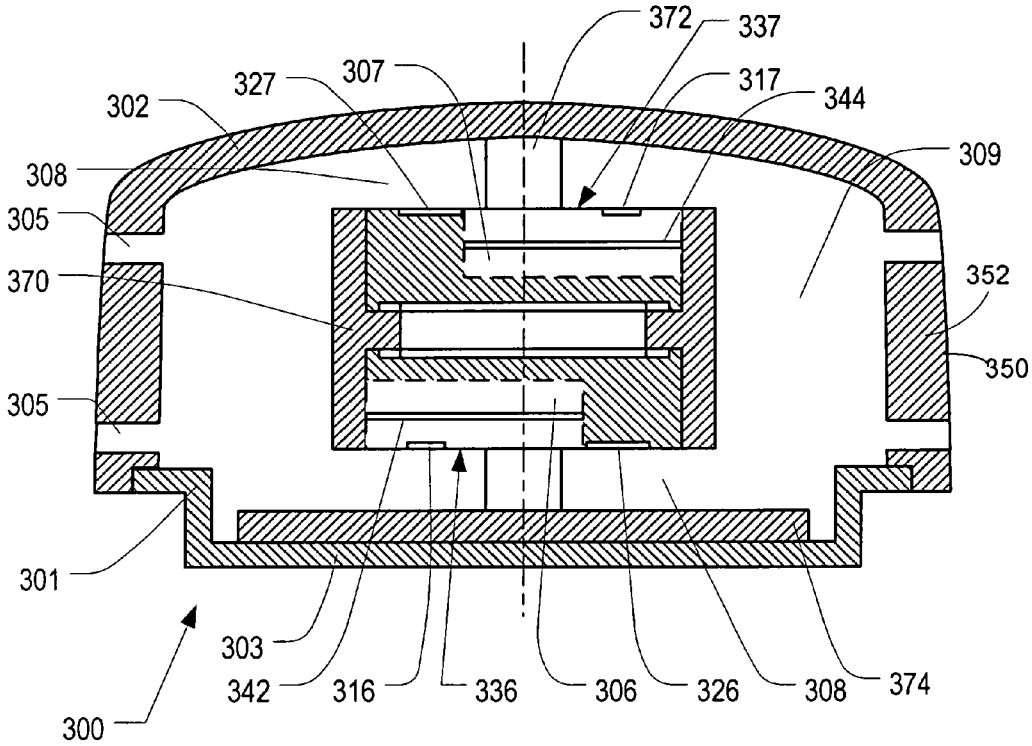
FIG. 3 is a second exemplary microphone system with two pressure-gradient capsules facing away from each other.

FIGS. 2 and 3 illustrate microphone systems 200 and 300 having two microphone capsules 216 and 217 and 306 and 307, respectively. In FIG. 2, for example, the microphone system 200 may have a capsule head in which the two microphone capsules 216 and 217 may be located. The two microphone capsules 216 and 217 may be separate from each other, and the capsules 216 and 217 may have diaphragms 262 and 264. To obtain a desired directional characteristic, the two capsules 216 and 217 may be arranged one over the other. The two capsules 216 and 217 may be turned so that two diaphragms 262 and 264 form an angle with respect to each other. The capsule head may be open with respect to surroundings and may be made from wire mesh or wire network so that sound enters in all directions.

In FIG. 2, the microphone system 200 has two pressure-gradient capsules 216 and 217. Alternatively, three or more capsules may be included. The capsules 216 and 217 may be located parallel to each other. The capsules 216 and 217 may be aligned with each other, so that entry surfaces 246 and 247 also are parallel to each other. An entry surface may include sound entry openings. The pressure-gradient capsules 216 and 217 may have diaphragms 262 and 264, respectively. Additionally, the pressure-gradient capsules 216 and 217 may have other structures such as an electrode, a spacer ring, a diaphragm ring, etc. (not shown).

A first set of sound entry openings 226 and 227 of the capsules 216 and 217, Respectively, is illustrated in FIG. 2. The first set of sound entry openings 226 and 227 may lead to a front side of the diaphragms 262 and 264, respectively. A second set of sound entry openings 236 and 237 may lead to a rear side of the diaphragm 262 and 264, respectively. The sound entry openings 226 and 236 and 227 and 237 are located on the entry surfaces 246 and 247, respectively, of the respective capsules 216 and 217. The entry surfaces 246 and 247 may be designated as front surfaces. The diaphragms 262 and 264 may be parallel to the entry surfaces 246 and 247, respectively. Alternatively, the entry surfaces 246 and 247 may be perpendicular to the diaphragms 262 and 264, respectively. In FIG. 2, a directional characteristic of the microphone capsules 216 and 217 may be asymmetrical to a diaphragm axis 265. This directional characteristic may be attained by arranging all sound entry openings 226 and 236 and 227 and 237 on the entry surfaces 246 and 247, respectively.

In the microphone system 200, sound entry openings 226 and 236 of the pressure-gradient capsules 216 may be directed into a slit-shaped space 218 as seen in cross sectional view. Alternatively, two slit-shaped spaces 308 may be formed, as is shown in FIG. 3. In FIG. 2, a closed boundary 252 may include the entry surface 246 of the pressure-gradient capsule 216. The space 218 may be disk-shaped because the capsules 216 and 217 are round. With a rectangular shape of the capsules 216 and 217, the space 218 may be rectangular shaped such as parallel pipes. Sound may enter into the space 218 laterally and continuously. Alternatively, sound may laterally enter at a certain place where the direction characteristic of the entire microphone system 200 may be influenced. Because of the closed boundary 252, sound arrives laterally at the space 218. Sound progresses in a direction parallel to the diaphragms 262 and 264 over the entry surface 246.

A functioning mode of microphone system 200 now is explained with reference to FIG. 2. A sound wave arriving in the space 218 from the left may reach the sound entry opening 227, which leads to the front side of the diaphragm of the capsule 217. A sound wave arriving in space 218 from the left may also reach sound entry opening 236, which leads to the rear side of the diaphragm of the capsule 216. With a delay, the sound wave then arrives at the sound entry opening 237, which leads to the rear side of the diaphragm 264 of the capsule 217. The sound wave also arrives at the sound entry opening 226 with delay, which leads to the front side of the diaphragm 262 of the capsule 216. This arrangement may be diametrically opposed. With this arrangement, the two pressure-gradient capsules 216 and 217 may generate signals with different information.

As noted above, the sound entry openings 226 and 227 and the sound entry openings 236 and 237 may be arranged to be symmetrically opposed to each other. This arrangement may deliver substantially identical signals. The identical signals may be merely added. Additional information does not need to be filtered out from the identical signals. The capsules 216 and 217 also may be angled slightly with respect to each other; when this occurs, two different signals may be produced. The capsules 216 and 217 may be turned relative to each other in two preferential directions like those of clock hands and further relative to the housing 201. The capsules 216 and 217 may be supported such that they may turn within the housing 201 for this purpose. This may occur, for example, with a screw or a lever (not shown), which projects through the housing 201.

In FIG. 2, the front surfaces of the two capsules 216 and 217 may face each other. Alternatively, the front surfaces of the two capsules 316 and 317 may be turned away from each other, as shown in FIG. 3.

When the two capsules 316 and 317 are turned away from each other, vibrations, impacts, etc., may cause a deflection of the diaphragms 262 and 264 relative to the capsule housing 201, because of inertia. In this situation, the vibrations, impacts, etc, may act on the microphone system 200 and happen in a direction vertical to the diaphragms 262 and 264, Such a situation may occur in motor vehicles, for example, where vertical vibrations may predominate. When the diaphragms are arranged horizontally, such as in a console serving as an interface, undesired interfering noises may develop. With the microphone system 200, however, the interfering signals induced as a result of the inertia of the diaphragms 262 and 264 may be deflected in the same direction and hence, may be combined together and disappear. As illustrated in FIG. 2, one capsule 217 may be positioned above relative to the other capsule 216. In this way, a signal having phase shifted by 180° may be formed. The compensation may concern only sound within a housing 201 and not sound arriving from surroundings that are lateral to the space 218.

The characteristics of the microphone system 200 may be influenced or adjusted as follows. The arrangement of sound entry openings 226, 227, 236 and 237 on the front surface, relative to each other, determines the directional characteristics of the capsules 216 and 217. The arrangement of the sound entry openings 226, 227, 236 and 237 may determine the directional characteristics of the combined signals. The arrangement of the sound entry openings on one capsule may not be necessarily identical with that of the sound entry openings on the other capsule. The directional characteristics may be different. Acoustical coordination of the individual microphone capsules 216 and 217 determines the direction characteristics of the combined signal. Acoustical coordination of the microphone capsules 216 and 217 may be kidney-shaped or hyper-kidney shaped. Kidney-shaped or hyper-kidney shaped directional patterns correspond to cardiode or hyper-cardiode directional patterns, which will be described more below. Two capsules 216 and 217 may not need to have an acoustically equal coordination of kidney shapes or hyper-kidney shapes; combinations of kidney shapes and hyper-kidney shapes in one microphone system are possible.

The location of the two capsules 216 and 217 with respect to each other may influence the formed signal. The two capsules 216 and 217 may be parallel and be displaced relative to each other and further relative to the housing 201. The displacement may be horizontal to the diaphragm axis 265. The orientation of the sound entry openings 226, 227, 236 and 237 of the two capsules 216 and 217 may be changed relative to each other and relative to the housing 201. In this way, a preferential direction may be generated, which may be adjusted similar to that of clock hands. For example, when using the microphone system 200, one beam may be focused in the direction of the driver in a motor vehicle and a second one may be focused in the direction of a passenger. By turning the capsules, the two beams also may be superimposed and only sound coming from the direction of the driver may be heard.

Audio signals of the two capsules 216 and 217 may be treated separately. The signals may be weighted and filtered before they are combined together for signal processing. The signal processing will be described in detail below in conjunction with FIG. 4. The directional characteristics of the microphone system 200 may be influenced to fade out interfering signals and/or give a preference to a certain sound source such as speech. In this way, the sensitivity of the microphone system 200 may be optimized.

In FIG. 2, the microphone system 200 includes the housing 211 that has a closed housing front 202 and a wall 214. The wall 214 may protrude from the outer circumference of the housing front 202 in the direction of a housing floor 213. As illustrated in FIG. 2, the housing 201 may be slightly curved. The housing front 202 may be closed without openings or slits, etc. The interior of the microphone system 200 may be completely covered. Dirt and dust, that may deposit on the housing front 202, do not reach the interior of the microphone system 200. Hence, the microphone system 200 may have better protection for mechanical components.

The design of the wall 214 and the housing openings 215 provide a barrier against airborne impurities and prevent them from entering the microphone system 200. Such impurities may damage the interior of microphone system 200 or make it unusable. The housing openings 215 for sound entry may be located on the wall 214 and may run parallel to the housing floor 213. Sound entry openings 226, 227, 236 and 237 may be inclined or perpendicular to the housing openings 215. The laterally arranged housing openings 215 also protects arriving sound so that it is undisturbed at the interior, of the microphone system 200.

In the housing 201, the two pressure-gradient capsules 216 and 217 may be arranged one above the other. The capsules 216 and 217 may be designed such that the sound entry openings 226 and 236 may be located on the same side of the capsule housing 201, i.e., the front surface 246. As noted above, two sound entry openings 236 and 237 may be connected to the rear side of the diaphragms 262 and 264 in an acoustically conductive manner. The other sound entry openings 226 and 227 may be connected to the front side of the diaphragms 262 and 264 in an acoustically conductive manner. Because the two sound entry openings 227 and 237 are placed at a distance from the other sound entry openings 226 and 236, a directional characteristic asymmetrical to the diaphragm axis 265 may be produced. The capsules 216 and 217 may occupy only a small space. In addition, the asymmetrical directional characteristic may vary depending on the orientation of sound entry openings. The individual microphone capsule 216 or 217 may be acoustically coordinated and therefore, all directional characteristics of the microphone system 200, such as spherical shape, number eight shape or octahedral shape are possible.

In FIG. 2, the space 218 may be disposed between the two capsules 216 and 217. The capsules 216 and 217 may be arranged such that the sound entry openings 226, 227, 236 and 237 of the two capsules 216 and 217 are directed into this space 218. The space 218 may be connected with the housing openings 215 via a sound channel 219 in an acoustically conductive manner. In the sound channel 219, material such as foam or the like may be supplied for acoustic friction. This design and material helps to prevent dust from penetrating into the interior of the microphone system 200.

The housing openings 215 may be located directly on the lateral entry of the housing 200. The housing openings 215 may be subdivided by structure such as a rib 267, which runs along the wall 214 around the microphone system 200. The rib 267 may be connected to several sides via crosslinks 210 with the housing front 202 and a meshing mechanism 212. The housing front 202 and the meshing mechanism 212 may fit closely on an edge 211 connected with the housing floor 213. The housing 201 may be constructed in two parts in FIG. 2. The cover may include the housing front 202 and the wall 214 along with the housing openings 215. The housing openings 215 may be removed from a housing substrate. Alternatively, various divisions other than the division of the front 202, the wall 214 and the housing openings 215 are possible. When the cover is removed, the capsules 216 and 217 may be easily accessed, for example, during assembly or replacement.

The capsules 216 and 217 may be mounted within the housing 201 with support members 270, as illustrated in FIG. 2. The type of support members 270, such as locking devices, glue, spacers between the capsules 216 and 217, clamps, etc. may be used. Additional support members 272 may be attached to the support member 270 for further securing the capsule 217. On the housing floor 213, a base plate or support plate 274 may be disposed. Openings 276 are formed in the base plate 274 and the housing floor 213. Wires pass through the openings 276. The support members 270, the additional support members 272, and the base plate 274 may be made from plastic, metal, sheet, glass, etc. It is appreciated by a skilled person in the art that various other support members may be used.

The housing openings 215 may not need to be uniformly distributed around an outer circumference of the housing 201. The housing openings 215 may be a single continuous opening, which may minimize disturbances by air movements. Alternatively, the housing openings 215 may not be a single continuous opening.

As noted above, in configurations where there are space limitations, the capsules 216 and 217 may be arranged parallel to the housing floor 213 and the housing front 202. The front surfaces 246 and 247 of the two capsules 216 and 217 may be parallel to each other. This arrangement may make the entire structure compact. Further, simultaneous use of the two microphone capsules 216 and 217 may enable multiple signal processing because the two microphone capsules 216 and 217 have their own directional characteristics. Signals of the capsules 216 and 217 may be different from each other. The signals may be processed, weighted, or filtered separately prior to their combination into one total signal based on algorithms of adaptive signal processing. As a result, desired directional characteristics and preferential directions may be produced. Further, interfering signals may be suppressed or eliminated. Each frequency range may be separately evaluated. One directional characteristic may be attained, independently of other frequency. Interfering noises of a working environment of a miniaturized coincidental microphone may be adapted to the surrounding in real time with digital adaptive signal processing. Speaking quality may further improve.

The capsules 216 and 217 may be arranged such that the sound entry openings 236 and 237 may be opposite to the sound entry openings 226 and 227. Sound entry openings 236 and 237 may lead to the rear side of the diaphragm. The sound entry openings 226 and 227 may lead to the front side of the diaphragm. As a result, two independent signals may be obtained with weighting, filtering, etc. and combined subsequently, which may produce a desired directional characteristic and sensitivity of the entire microphone system 200.

In the microphone system 200, impacts and vibrations may not play a substantial role. The capsules 216 and 217 may be located next to each other. The entry surfaces 246 and 247 may form a lower limit of the slit shaped space 218. The upper wall of the slit 218 may be formed by an inside of the housing front 202 or a plate connected with the housing front 202. The distance between the housing floor 213 and the housing front 202 may be wider than the conventional microphone system 200 illustrated in FIG. 1. A base surface having extended dimensions may be needed. Depending on need and space, dimensions may be changeable.

The directional characteristic may be changed, for instance, from spherical characteristic to super-kidney shaped characteristic. The change of the directional characteristic gradually proceeds through octahedral-shape characteristic, kidney-shape characteristic, and hyper-kidney shaped characteristic. Super-kidney shaped characteristic and hyper-kidney shaped characteristic also may be referred to as supercardioid characteristic and cardioid characteristic, respectively, as known to the skilled person in the art. Kidney shaped or cardiode directional characteristic indicates that a microphone is less sensitive to sound approaching from the rear and more sensitive to sound approaching from the front. Super-kidney shaped characteristic or supercardiode characteristic has similar sensitivity as that of the cardiode characteristic to sound approaching from the front and additionally, may pick up some sound from the rear. The change of the directional characteristic may be carried out continuously and adaptively in real time with signal processing algorithms and/or simple turning of the capsules 216 and 217 with respect to each other. By way of example only, as the capsules 216 and 217 are turned relative to each other from parallel positions, the directional characteristic may be changed from spherical characteristic to super-kidney shaped characteristic.

By using this special capsule type, the asymmetrical directional characteristic may be produced. Alternatively, or additionally, parallel and simultaneous aligning arrangement of two capsules may produce an asymmetrical directional characteristic. This arrangement may save space and hence, be suitable for miniaturized microphones without producing a qualitative loss.

FIG. 3 illustrates another example of a microphone system 300. The microphone system 300 includes two pressure-gradient capsules 306 and 307, a housing 301 and housing openings 305. Alternatively, three or more capsules may be included in the housing 301. The housing 301 also includes a housing floor 303 and a space 308 is formed within the housing 301. The pressure-gradient capsules 306 and 307 may be secured to the housing 301 with supporting members 370. A holder 372 and a base plate 374 also may be used to submit the capsules 306 and 307.

In FIG. 3, front surfaces 336 and 337 of the two capsules 306 and 307 may be turned away from each other and each of the two capsules 306 and 307 may be directed into space 308. The space 308 may have slit-shape and be surrounded by a closed plate or wall. The closed plate or wall may be in a direction perpendicular to an individual front surface 336 or 337. The slit-shaped space 308 may be connected with the housing openings 305 in an acoustically conductive manner such as a sound channel 309. In the slit-shaped space 308, materials such as foam may be supplied for acoustic friction or as a dust trap.

Two openings may be provided for the front and rear side sound entry: two openings 316 and 326 for the capsule 306 and the other two openings 317 and 327 for the capsule 307. Alternatively, a single sound entry opening may be provided. Additionally, several smaller openings may be arranged in one group for the front sound entry. Further, several smaller opening may be arranged in one group for the rear sound entry. In FIG. 3, the housing openings 305 may be located directly on the lateral entry of the housing 301.

In FIG. 3, the capsules 306 and 307 may be arranged such that the sound entry openings 326 and 327 may be opposite to the sound entry openings 316 and 317. The sound entry openings 326 and 327 may lead to the rear side of the diaphragms 342 and 344. The sound entry openings 316 and 317 may lead to the front side of the diaphragms 342 and 344. As a result, two independent signals may be obtained with weighting, filtering, etc. and combined subsequently, which may produce a desired directional characteristic and sensitivity of the entire microphone system 300.

In FIG. 3, the directional characteristics may be changed from spherical characteristics to super-kidney shaped characteristics. During this change, the direction characteristics may sequentially develop octahedral-shape characteristics, kidney shaped characteristics and hyper-kidney shaped characteristics. The change of the directional characteristics may be carried out continuously and adaptively in real time with signal processing algorithms and/or simple turning of the capsules 306 and 307.

In FIG. 3, the sound entry openings 316, 317, 326 and 327 may be directed into the slit-shaped space 308. The slit-shaped space 308 may be connected in an acoustically conductive manner. The plate or wall 350 may be integrated in the housing wall 352 or formed by the housing wall 352. In FIG. 3, the space 308 may have a first extended portion in a direction parallel to the entry surfaces 336 and 337. In FIG. 3, the first extended portion is larger than a second extended portion in a direction perpendicular to the entry surfaces 336 and 337.

The first extended portion of the space 308 may be at least twice as large as the second extended portion. The first extended portion may be around five times, or greater, as large as the second extended portion. Alternatively, the first extended portion may be around ten times, or greater, as large as the width of the slit-shaped space 308. Due to this arrangement, space may be saved and difference between the two signals of the capsules 306 and 307 may increase with a smaller width of the space 308.

As noted above, the microphone system 200 and 300 may have sound entry openings 226, 227, 316 and 317 connected with the front side of the diaphragms in an acoustically conductive manner and the other sound entry openings 236, 237, 326 and 327 connected with the rear side of the diaphragm in an acoustically conductive manner. The sound entry openings may be located in each of the pressure-gradient capsules 216, 217, 306 and 307 on their entry surfaces. The diaphragms of the pressure-gradient capsules 216, 217, 306 and 307 may be oriented substantially parallel to each other. The sound entry openings 226, 227, 236, 237, 316, 317, 326 and 327 may be directed into a space, which may be closed in a direction perpendicular to the entry surfaces and connected with the housing openings 215 and 305 in an acoustically conductive manner. The closed boundary of the space perpendicular to the entry surface may prevent sound from arriving perpendicularly to the entry surface and openings, respectively. The miniaturized, coincidental microphone systems 200 and 300 may save space and have variable directional characteristics.

The microphone system 200 and 300 may be compact. The microphone systems 200 and 300 also may create directional characteristics and preferential directions, which may be suitable for use in automobile conference rooms and cockpits. With a parallel and preferentially aligning arrangement of the pressure-gradient capsules with respect to each other, compact microphones may be produced. Good acoustical characteristics may be obtained. Microphone systems 200 and 300 of this type may have a size of a button and may be placed inconspicuously on service consoles of hands-free devices or shirt collars, etc. The microphones may be particularly suited for incorporation into an interface such as an instrument panel of a motor vehicle, walls, table surfaces, etc. With the interface, the direct sound may be preferentially detected, and reverberation portions and reflections may be kept small. In FIGS. 2 and 3, the microphone system having two pressure-gradient capsules is described. Alternatively, or additionally, the microphone system may have three or more pressure-gradient capsules. The skilled in the art may appreciate that the microphone system is not limited to two pressure-gradient capsules.

Figure 4:
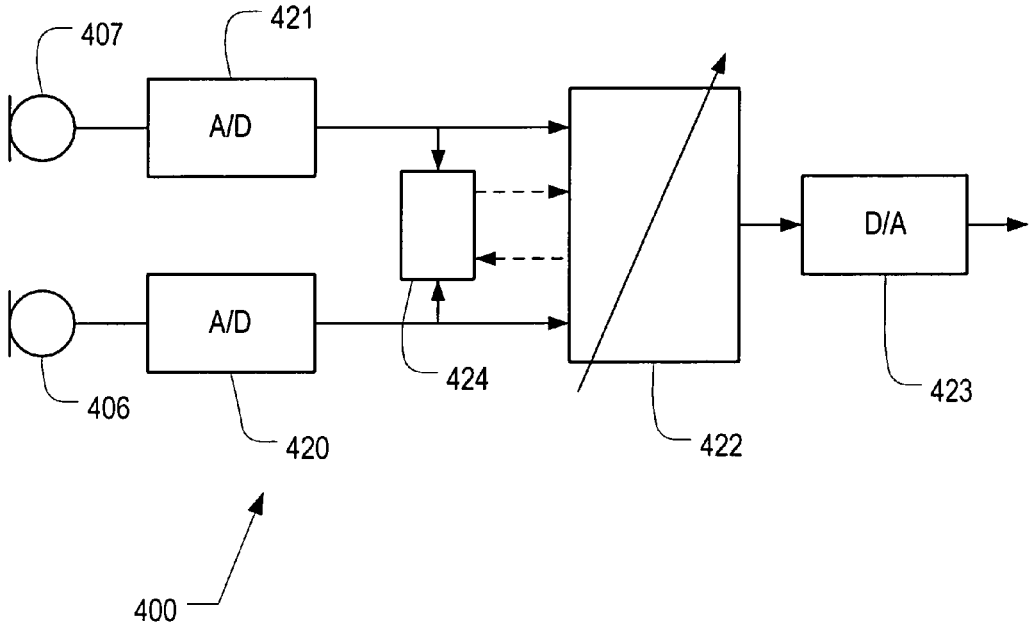
FIG. 4 is a block diagram of an exemplary microphone system capable of adaptive signal processing.

FIG. 4 is a block diagram illustrating a microphone system 400 capable of adaptive signal processing. Microphone system 400 may represent the microphone systems 200 and 300, previously discussed, or it may be another microphone system in accordance herein. Capsules 406 and 407 may generate independent signals. For digital signal processing, each signal may be converted into a digital signal with analog-to-digital ("A/D") converters 420 and 421. An adaptive filter 422 may process the converted signals. The resulting signal may be converted into an analog signal with a digital-to-analog ("D/A") converter 423. In FIG. 4, solid lines represent signals with acoustical information, and dotted lines represent control signals for changing properties of the adaptive filter 422. For example, the control signals may include filter coefficients, algorithms, etc. The control signals may be generated as a result of processing and analyzing the two independent capsule signals in a control unit 424. The control signals may control the adaptive filter 422. The control signals may be generated by the adaptive filter 422 as feedback and sent to the control unit 424 to carry out the implemented functionality.

Two examples are discussed. In both examples, a first capsule of a microphone system may be directed to a driver of a vehicle such as a car, a train, etc. A second capsule of the microphone system may be directed to a passenger or passengers.

EXAMPLE 1

The control unit 424 may include a "Voice-Activation" algorithm and identify which of two capsules 406 and 407 provides speech and interfering signals and/or which of the two capsules 406 and 407 provides interfering signals only. The adaptive filter 422 may suppress an undesired capsule input, i.e., only interfering signals, and equalize the desired signal, i.e., speech, for example, with a monaural filter for increasing understandability of speech. Use of two directional capsules 406 and 407 may allow sound to be detected only from the desired direction and suppress interfering sound from all other directions. Space required for the microphone may be the same as that for a single capsule microphone. Signal to noise ratio may significantly improve.

EXAMPLE 2

The control unit 424 may include an algorithm that suppresses an interfering noise. As noted in Example 1, the first capsule 406 may be directed to the driver and the second capsule 407 to the co-driver. The control unit 424 may detect which of two people is currently speaking. The signal without speech may be used in the control unit 424 to more precisely estimate the nature of diffusing interfering noise in a vehicle such as a car, train, etc., because a signal may contain speech in addition to an interfering signal. The estimate of the interfering signal may serve as. Vernier adjustment and no longer serve as only a possible sound source. Vernier adjustment makes possible accurate readings to a detailed level of measurements. The algorithm may enable processing of an interfering speech signal in addition to processing of the speech signal. Further, the microphone system may detect two signals, i.e., a desired signal and interfering signals in the same place. As a result, the accuracy of estimation of the interfering signals may substantially increase and the interfering signals may be consequently suppressed.

Figure 5:
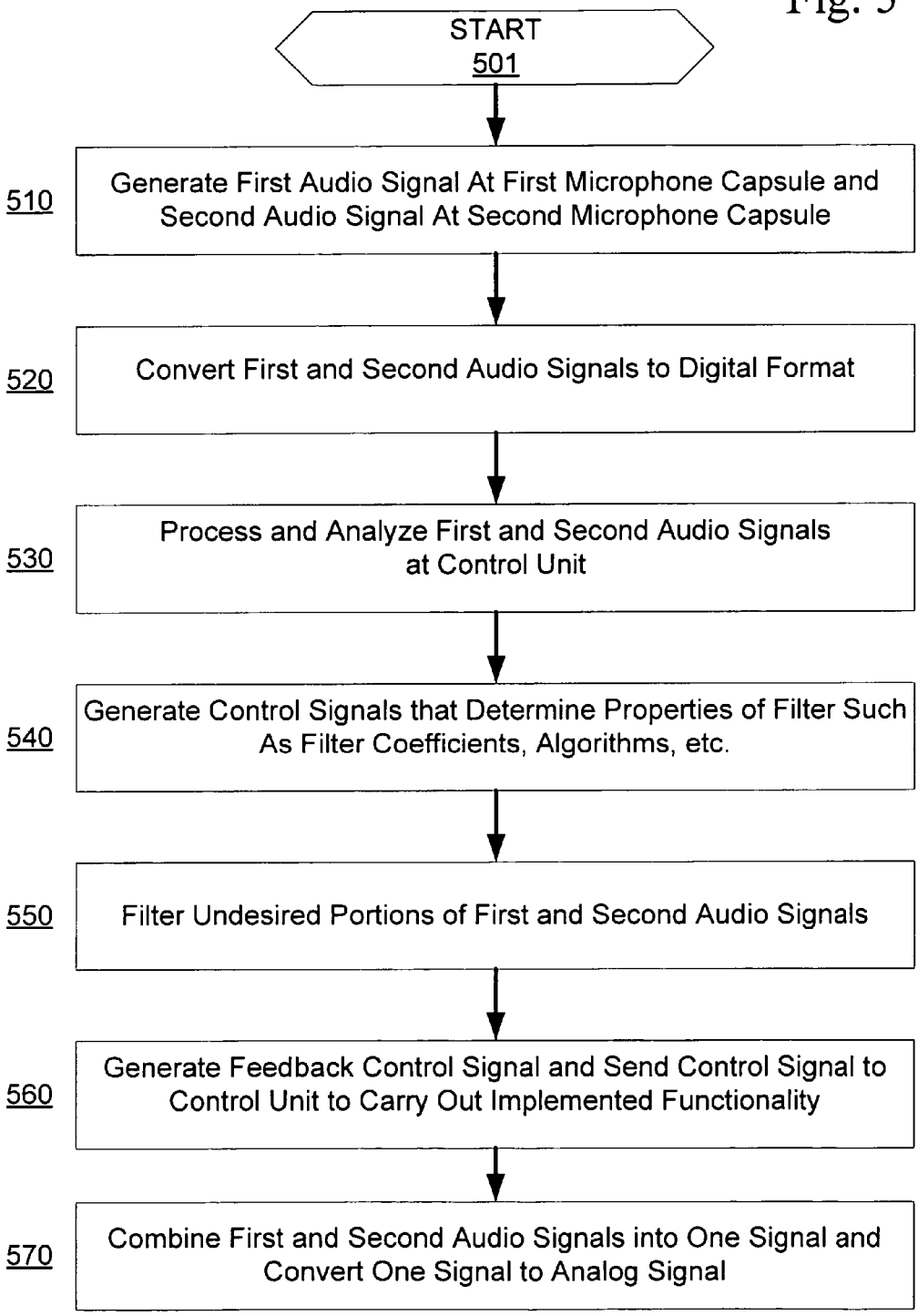
FIG. 5 is an exemplary flowchart illustrating signal processing of a microphone system.

FIG. 5 is a flowchart illustrating signal processing of a microphone system such as the microphone systems 200, 300, and/or 400 of FIGS. 2, 3, and 4, respectively. The microphone systems may include at least first and second pressure-gradient microphone capsules. The first capsule generates a first audio signal and the second capsule generates a second audio signal (510). The first and second audio signals may have different directional characteristics. The first and second audio signals may be converted into a digital format (520). The first and second audio signals may he processed and analyzed at a control unit (530). The control unit may determine that the first and second audio signals may include inferring signals or speech signals. Additionally, the control unit may determine how much interfering signals may be diffused with the speech signals. The control unit may determine from which direction the signals are coming.

Based on the analysis of the control unit, the first and second audio signals may be transferred to an adaptive filter, which in turn filters the audio signals (550). The control unit may determine and adjust properties of the adaptive filter based on filter coefficients, algorithms, etc. (540). For instance, the control unit may determine values of the filter coefficients and control the adaptive filter to perform filtering with the determined filter coefficients. The adaptive filter may generate feedback control signal (560). The feedback control signal may be sent to the control unit so that the control unit may carry out implemented functionality. The processed and filtered signals may be combined into one signal, which is converted into an analog signal (570). As shown in FIG. 5, two audio signals may be processed, weighted or filtered separately based on algorithms of an adaptive signal processing.

Figure 6:
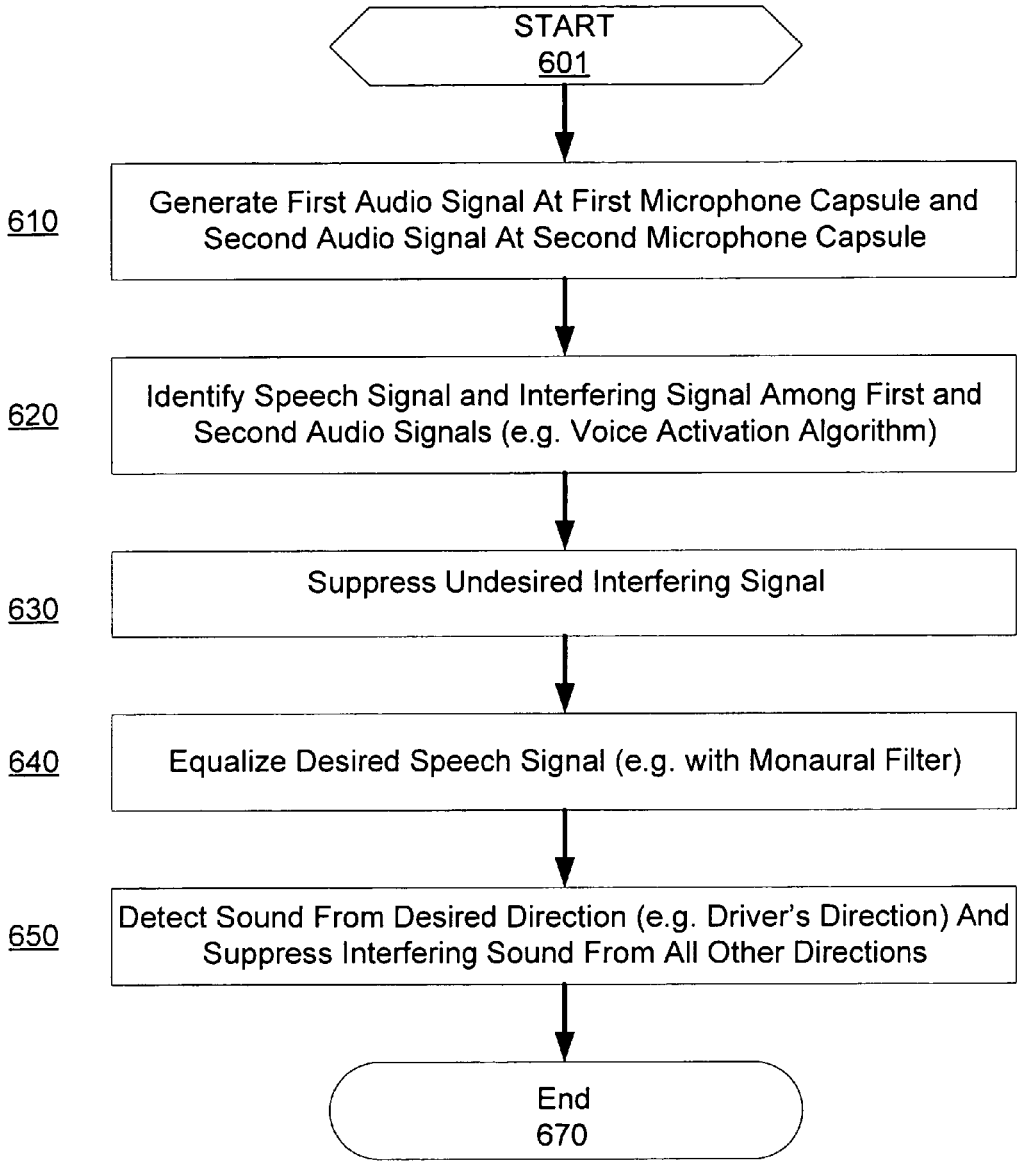
FIG. 6 is an exemplary flowchart illustrating signal processing in a microphone system for use in a vehicle.

FIG. 6 is a flowchart illustrating one example of a signal processing of a microphone system in a vehicle. Ill the vehicle, space may be limited and occupants involve a driver and passengers. The microphone system bas two pressure-gradient capsules that generate first and second microphone audio signals (610). A control unit may identify speech signal and interfering signals, e.g., noise, among the first and second audio signals (620). For instance, the control unit may employ a voice activation algorithm. In that case, voice activation operation based on the interfering signals may cause errors or mistakes in the vehicle electronic systems. After identification, the interfering signals may be suppressed (630). On the other hand, a desired speech signal may be equalized, for instance, with a monaural filter (640). When a driver is a sole occupant of the vehicle, or passengers' voice instructions may need to be ignored, it is possible to detect audio signals that come from the driver's direction only. Audio signals that come from other directions may be suppressed (650).

Figure 7:
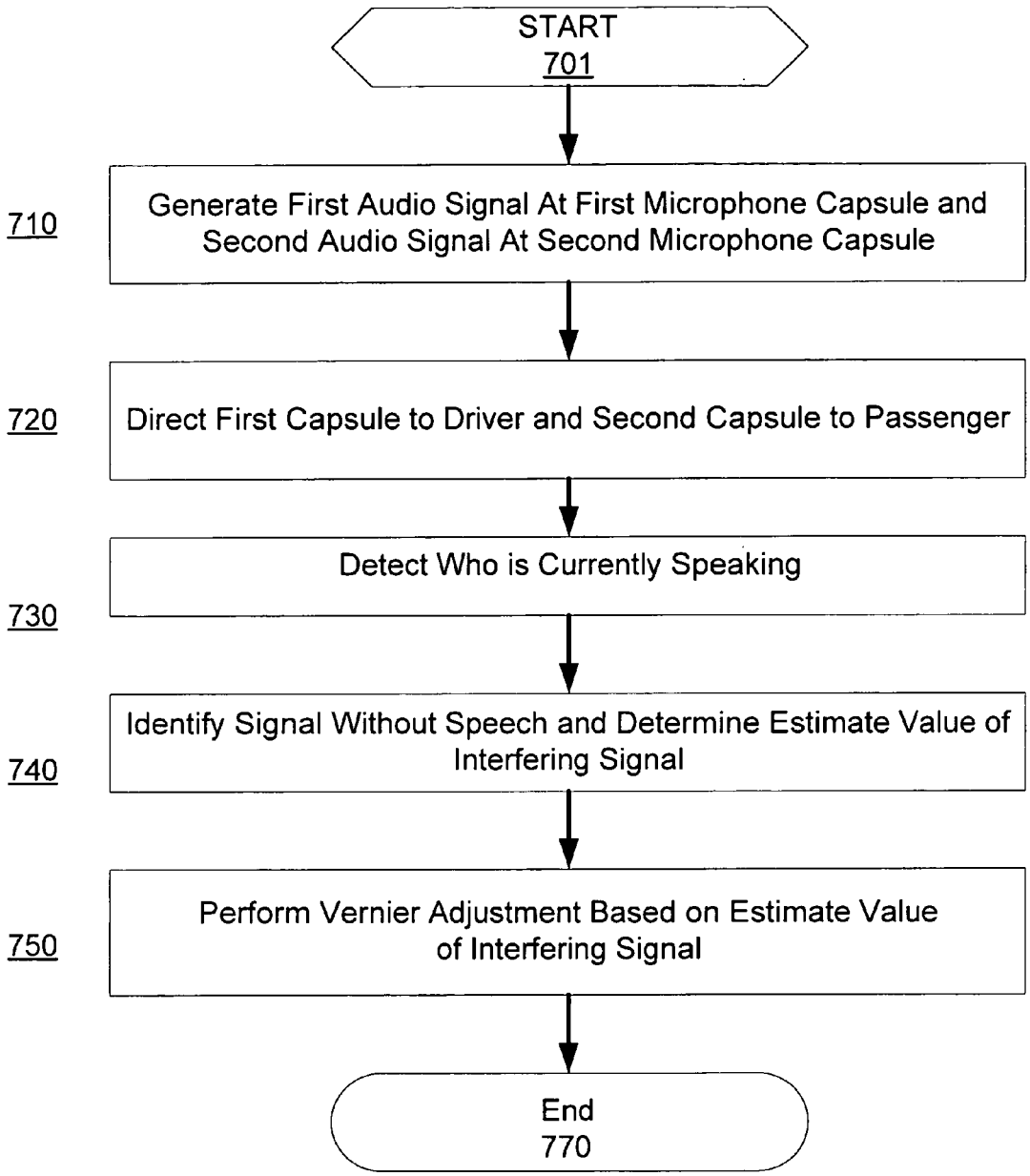
FIG. 7 is another exemplary flowchart illustrating signal processing with Vernier adjustment in a microphone system for use in a vehicle.

FIG. 7 is a flowchart illustrating another example of signal processing of a microphone system in a vehicle. The microphone system includes two capsules which generate first and second audio signals (710). A first capsule may be directed to a driver and a second capsule may be directed to a passenger (720). A control unit may detect who is currently speaking between the driver and passengers (730). The control unit further may identify signal without speech, i.e., pure interfering signals (740). The control unit may determine an estimated value of the interfering signals (740). The estimated value of the interfering signals may be diffused to the speech signal in a restricted space of the vehicle. The speech signal may not be only sound source. Based on the estimated value of the interfering signals, Vernier adjustment may be performed (750). The control unit may employ an algorithm that processes the speech signal and the interfering signals in the same place. The interfering signals may be eventually suppressed with more accuracy.

As described in FIGS. 5-7, audio signals from the two microphone capsules may be processed and filtered separately and combined into one signal. The two microphone capsules may be directed into a different direction and each audio signal generated at the microphone capsules may be different from each other. The different audio signals may be evaluated and processed separately. For instance, one audio signal may be suppressed and the other audio signal may be equalized. At least one of the different audio signals may be used to provide adaptive signal processing. The audio signals may be processed to reflect noise levels, direction of audio signals, surrounding of the microphone capsules, etc.

We claim:

1. A microphone system for use with hands-free devices, comprising:

a housing including a housing opening; and two pressure-gradient capsules disposed in the housing, each of the pressure-gradient capsules having an entry surface and further including:

a diaphragm having a front side and a rear side;

a first sound entry opening connected with the front side in an acoustically conductive manner; and a second sound entry opening located on the same entry surface as the first sound entry opening and connected with the rear side in an acoustically conductive manner;

where the first sound entry opening and the second sound entry opening are located on the entry surface of the pressure-gradient capsule with the pressure-gradient capsules being angularly aligned with respect to each other and a front surface of one pressure-gradient capsule faces a front surface of the other pressure-gradient capsule where the entry surface is a front surface.

2. The microphone system of claim 1, where the first sound entry opening and the second sound entry opening are directed into a space formed within the housing.

3. The microphone system of claim 2, where the space is configured to be closed in a direction perpendicular to the entry surface and connected with the housing opening in an acoustically conductive manner.

4. The microphone system of claim 1, where the pressure-gradient capsules are aligned parallel to a surface of the diaphragm.

5. The microphone system of claim 2, where the space is formed between front surfaces of the pressure-gradient capsules.

6. The microphone system of claim 2, where front surfaces of the two pressure-gradient capsules face away from each other where the entry surface is a front surface.

7. The microphone system of claim 6, where the front surfaces are directed into the space.

8. The microphone system of claim 1, where the first sound entry opening and the second sound entry opening are disposed opposite to each other.

9. The microphone system of claim 1, where at least one of the pressure-gradient capsules is supported in the housing in a way that the pressure-gradient capsule is capable Of being turned with respect to the diaphragm.

10. The microphone system of claim 1, where the two pressure-gradient capsules are arranged in the housing between a housing floor and a closed housing front.

11. The microphone system of claim 10, where the closed housing front is curved and substantially parallel to the housing floor.

12. The microphone system of claim 11, where the housing opening is located in a wall.

13. The microphone system of claim 10, where the housing opening is substantially parallel to the closed housing front

14. The microphone system of claim 2, further comprising a sound channel supplied between the space and the housing opening.

15. The microphone system of claim 14, where the sound channel is filled at least in part with flexible material.

16. The microphone system of claim 15, where the flexible material comprises one of foam, fiber and wool.

17. The microphone system of claim 15, where the sound channel comprises at least one of a step or a rib.

18. The microphone system of claim 2, where the space is extended in a direction substantially parallel to the entry surface and a length of the extended portion of the space is about twice a width of the space.

19. The microphone system of claim 2, where the space is extended in a direction substantially parallel to the entry surface and a length of the extended portion of the space is more than twice a width of the space.

20. The microphone system of claim 2, where the space is extended in a direction substantially parallel to the entry surface and a length of the extended portion of the space is about five times a width of the space.

21. The microphone system of claim 2, where the space is extended in a direction substantially parallel to the entry surface and a length of the extended portion of the space is more than five times a width of the space.

22. The microphone system of claim 2, where the space is extended in a direction parallel to the entry surface and a length of the extended portion of the space is about ten times a width of the space.

23. The microphone system of claim 2, where the space is extended in a direction parallel to the entry surface and a length of the extended portion of the space is more than ten times a width of the space.

24. A microphone system, comprising:

a housing including a housing opening; and two pressure-gradient capsules disposed in the housing, each of the pressure-gradient capsules includes an entry surface and further including:

a diaphragm having a front side and a rear side;

a first sound entry opening connected with the front side in an acoustically conductive manner; and a second sound entry opening located on the same entry surface as the first sound entry opening and connected with the rear side in an acoustically conductive manner;

where the first sound entry opening and the second sound entry opening are located on the entry surface of the pressure-gradient capsule, and where the two pressure-gradient capsules disposed in the housing comprise a first pressure-gradient capsule and a second pressure-gradient capsule, the first pressure-gradient capsule operable to generate a first audio signal and the second pressure-gradient capsule operable to generate a second audio signal and the pressure gradient capsules being angularly aligned with respect to each other such that a front surface of one pressure-gradient capsule faces a front surface of the other pressure-gradient capsule where the entry surface is a front surface, where the first and second pressure-gradient capsules are disposed to produce directional characteristics of the first audio signal and the second audio signal; and a sound signal processing unit including:

a controller operable to receive and analyze the first and second audio signals from the first and second pressure-gradient capsules; and an adaptive filter operable to filter the first audio signal and the second audio signal in response to a control signal supplied from the controller.

25. The microphone system of claim 24, where the sound signal processing unit further comprises:

an analog-to-digital converter placed between the first and second pressure-gradient capsules and the controller; and a digital-to-analog converter placed subsequent to the adaptive filter.

26. The microphone system of claim 24, where the controller determines a filter coefficient based on analysis of the first and second audio signals.

27. The microphone system of claim 26, where the adaptive filter operates with the filter coefficient.

28. The microphone system of claim 27, where the adaptive filter generates a feedback control signal and provides it to the controller.

29. The microphone system of claim 24, where the first capsule is directed to a driver of a vehicle and a second capsule is directed to a passenger of the vehicle.

30. A microphone system, comprising:

a housing including a housing opening; and two pressure-gradient capsules disposed in the housing, each of the pressure-gradient capsules includes an entry surface and further including:

a diaphragm having a front side and a rear side;

a first sound entry opening connected with the front side in an acoustically conductive manner; and a second sound entry opening located on the same entry surface as the first sound entry opening connected with the rear side in an acoustically conductive manner;

where the first sound entry opening and the second sound entry opening are located on the entry surface of the pressure-gradient capsule and the pressure-gradient capsules being angularly aligned with respect to each other such that a front surface of one pressure-gradient capsule faces a front surface of the other pressure-gradient capsule where the entry surface is a front surface;

means for generating a first audio signal and a second audio signal where the first audio signal and the second audio signal have different directional characteristics;

control means for receiving and analyzing the first and second audio signals; and filter means for suppressing an interfering signal and equalizing a desired signal in response to a control signal provided from the control means where each of the first and second audio signals include at least one of the interfering signal or the desired signal.

31. The microphone system of claim 30, where the control means operates to determine properties of the filter means, where the properties include a filter coefficient.

32. The microphone system of claim 30, where the filter means operates to format the first and second audio signals in response to a working environment of the microphone system.

* * * * *